US007895935B2

(12) United States Patent
Kells

(10) Patent No.: US 7,895,935 B2
(45) Date of Patent: Mar. 1, 2011

(54) TOROIDAL RAM ACTUATOR

(76) Inventor: James Antony Kells, Brighton (AU)

( * ) Notice: Subject to any disclaimer, the term of this patent is extended or adjusted under 35 U.S.C. 154(b) by 279 days.

(21) Appl. No.: 11/922,939

(22) PCT Filed: Jun. 30, 2006

(86) PCT No.: PCT/AU2006/000931

§ 371 (c)(1),
(2), (4) Date: Feb. 27, 2008

(87) PCT Pub. No.: WO2007/003000

PCT Pub. Date: Jan. 11, 2007

(65) Prior Publication Data

US 2009/0031718 A1 Feb. 5, 2009

(30) Foreign Application Priority Data

Jun. 30, 2005 (AU) ..... 2005903471

(51) Int. Cl.
*F01C 9/00* (2006.01)

(52) U.S. Cl. ..... 92/120

(58) Field of Classification Search ..... 92/67, 92/120

See application file for complete search history.

(56) References Cited

U.S. PATENT DOCUMENTS 3,070,075 A 12/1962 Hanselmann
3,246,580 A 4/1966 Huska
4,242,947 A 1/1981 Remmer et al.
4,577,549 A * 3/1986 Frank et al. ..... 92/169.1
4,628,797 A * 12/1986 Kendall ..... 92/120
5,007,330 A * 4/1991 Scobie et al. ..... 92/120
5,044,257 A 9/1991 Scobie
5,054,374 A * 10/1991 Scobie et al. ..... 92/120
5,386,761 A 2/1995 Holtgraver
5,495,791 A * 3/1996 Sande et al. ..... 92/120

FOREIGN PATENT DOCUMENTS

DE 871 557 3/1953
DE 3016427 A1 4/1983
EP 0075511 A2 3/1983
EP 0098614 A2 1/1984
EP 0181971 B1 5/1986
EP 1 429 037 6/2004
GB 1310105 3/1973
GB 1518061 7/1978
GB 2312248 A 10/1997

* cited by examiner

*Primary Examiner*—Michael Leslie
(74) *Attorney, Agent, or Firm*—The Webb Law Firm

(57) ABSTRACT

A toroidal ram actuator comprising a part toroidal shaped cylinder mounted to a first member and a part toroidal piston reciprocally movable within the cylinder, a free end of the piston being mounted to a second member, wherein the first and second members are pivotally attached along an axis and the relative movement between the cylinder and piston produces rotary motion of the first or second member about the axis.

21 Claims, 5 Drawing Sheets

TOROIDAL RAM ACTUATOR

The present invention relates to a ram actuator that operates under fluid pressure to produce rotary motion.

BACKGROUND OF THE INVENTION

In fields of engineering rotary motion of an actuator or mechanism is obtained by the use of a linear acting hydraulic or pneumatic ram acting on a linkage or mechanical arm about a pivoting axis.

Several problems exist with this means of obtaining rotary motion. Firstly, the space required to package the open-close movement of a linear acting ram is often large and undesirable. Secondly, the mechanical linkages involved limit the output rotation angle about the pivoting axis. Thirdly, the corresponding output torque about the pivoting axis varies dramatically depending upon the perpendicular component of force applied by the linear ram acting about the pivoting axis. And fourthly there are undesirable force vectors acting on the pivoting axis and surrounding components, requiring additional strengthening of such surrounding components.

The present invention provides a means of producing useful rotary motion in a compact manner and with a consistent and potentially high output torque.

SUMMARY OF INVENTION

According to the present invention there is provided a toroidal ram actuator comprising a part toroidal shaped cylinder mounted to a first member and a part toroidal piston reciprocally movable within the cylinder, a free end of the piston being mounted to a second member, wherein the first and second members are pivotally attached along an axis and the relative movement between the cylinder and piston produces rotary motion of the first or second member about the axis.

BRIEF DESCRIPTION OF THE DRAWINGS

An embodiment, incorporating all aspects of the invention, will now be described by way of example only with reference to the accompanying drawings in which.

DETAILED DESCRIPTION OF PREFERRED EMBODIMENT

Figure 1A:
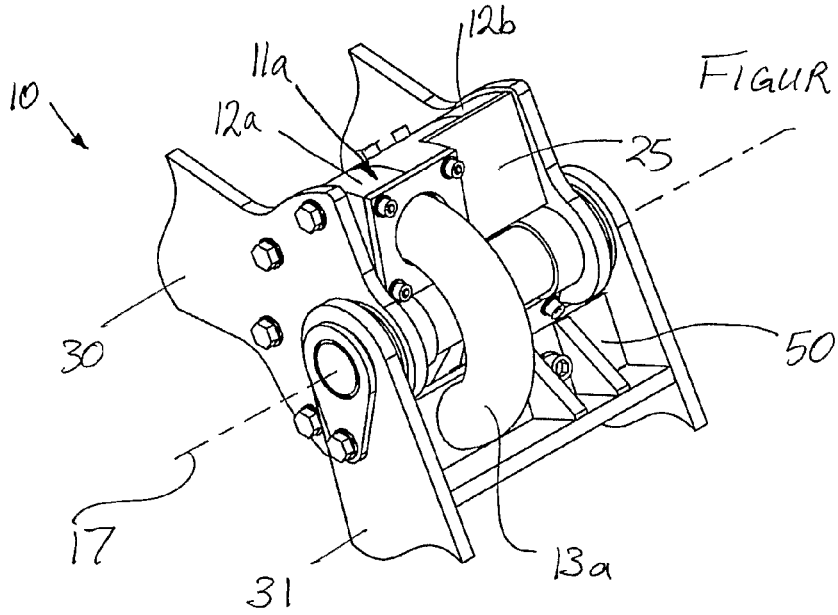
FIG. 1*a* is an isometric view of a toroidal ram actuator in accordance with an embodiment of the present invention, illustrating a first ram in a fully extended position.

In the preferred embodiment of the invention shown in the drawing, a toroidal ram actuator 10 consists of two opposing single acting toroidal rams 11. It is understood however that the principle of the actuator may operate with a double acting toroidal ram.

In this specification the definition of toroidal is 'geometry of, or resembling a torus' and the definition of torus is 'a surface or solid formed by rotating a closed curve, especially a circle, about a line which lies in the same plane but does not intersect it', for example, a ring doughnut.

The device consists of two identical, but axially offset toroidal rams 11 which are inverted, namely rotated by 180°, relative to each other such that a first ram appears 'upside down' to a second ram. The toroidal rams 11 each comprise a toroidal cylinder 12 and a toroidal piston, or rod, 13 moveable within the cylinder 12. The cylinders have an enclosed, internal toroidal surface 15 that is circular in cross-section. The cylinders are approximately semi toroidal, namely approximately half a revolution in length. A toroidal axis 17 is defined by the common central axis of the toroidal cylinders. The toroidal cylinders are rigidly attached to one another forming a single body referred to as a toroidal cylinder housing 16.

Each toroidal cylinder is closed at one end, the tail end 19, and the rod 13 is adapted to extend from the other end which is open and referred to as the open head end 18. An internal chamber 20 between the head end and tail end is adapted to hold fluid for actuating the rod hydraulically or pneumatically. The fluid used may, for example, be hydraulic oil or compressed air.

The head end 18 of each cylinder 12 is provided with seal gland(s) 21 for supporting pressure seal(s) 22. The tail end 19 of each cylinder is closed off by means of an end cap 25 attached by welding or otherwise. The housing 16 which houses both cylinders 12 is rigidly attached to a static member, or fixed link 30. The opening of the head end 18 of each cylinder 12 allows the insertion of the toroidal rod 13 which reciprocally extends and retracts within the cylinder.

In the preferred embodiment of the actuator 10, each cylinder 12 contains a wear sleeve 26 which acts as a wearing and guiding surface for each rod inside the cylinder. The wear sleeve 26 is adapted to evenly guide and fully support the rod as it extends and retracts to thereby prevent the rod from rocking or distorting under a load. The sleeve is made of a wearable material, such as a composite material, for example nickel filled polytetrafluoroethylene or similar, to allow the rod to move smoothly inside the cylinder.

The geometry of the sleeve 26 is similar to that of the cylinder in which it is housed such that the sleeve 26 can be inserted into its corresponding cylinder 12 through the open head end 18. The sleeve 26 is also circular in cross section. A clearance between the sleeve and internal surface of the cylinder 12 compensates for any misalignments of the rod supported inside the sleeve or if the rod does not follow a true toroidal path. The clearance also facilitates sleeve insertion into the cylinder.

Each rod 13 is a solid member made of steel or other suitable metal, is a semi-torus in shape and has a circular cross section. The rods may be heat treated/hardened and/or chromed for greater durability and wear characteristics. The rod 13 is guided and can move freely within its corresponding cylinder 12. Accordingly, the rod has one degree of freedom, that being the circular path the rod partly subscribes about the toroidal axis 17.

A leading end 28 of the rod protrudes from the head end 18 of the cylinder 12 when the rod is fully retracted in the cylinder. The leading end 28 of each rod is attached to and acts against a dynamic member, namely a dynamic link 31, which is movable relative to the fixed link 30. The dynamic link 31 is attached to and rotates about fixed link 30. The dynamic link 31 also has one degree of freedom, that being the same as the rod, namely a part circular path about the toroidal axis 17.

As the two cylinders 12 are in line but axially offset to the toroidal axis 17, and inverted relative to each other so that the head end 18 of the cylinders are diametrically opposed, the rods 13 act in opposition to each other on the dynamic link 31.

Each rod 13 is rigidly attached to the dynamic link 31 by using a bolt 38 or other similar fastener to fasten the leading end 28 of the rod to a reaction surface 50 on the dynamic link 31. The first and second rods 13*a*, 13*b* are attached to opposite sides of reaction surface 50.

Reaction surface 50 is machined to allow an accurate relationship between its opposite surfaces on which the rods 13*a*, 13*b* bear against and the toroidal axis 17 about which the rods 13 and dynamic link 31 rotate.

Accordingly, actuation of a first ram 11*a* extends a first rod 13*a* in a clockwise direction about the toroidal axis thereby also moving dynamic link 31 in the clockwise direction, whereas actuation of a second ram 11*b* extends the second rod 13*b*, and hence the dynamic link, in an anti-clockwise direction. Ram actuation is alternated between the first and second rams.

Actuation of the toroidal rams illustrated in the drawings is carried out by a single acting cylinder in the rams such that fluid is introduced into the cylinder through inlet/outlet ports 33*a*, 33*b*, to force the rod 13 to move outwardly of the cylinder under the pressure of increasing fluid. During retraction fluid is forced out of the cylinder through the same inlet/outlet port under the pressure of the rod being pushed back into the housing by the force of the opposing rod.

The inlet/outlet ports 33*a*, 33*b* are a through hole from the outside of each cylinder to the inside chamber 20. Each inlet/outlet port may have welded to it on the outside, a suitable hydraulic or pneumatic fitting to allow a corresponding hydraulic or pneumatic hose or fitting to be attached.

In operation, hydraulic or pneumatic fluid is fed into the first cylinder 12*a* via its corresponding inlet/outlet port 33*a*. The first cylinder 12*a* becomes pressurized. Simultaneously, hydraulic or pneumatic pressure is relieved from the second cylinder 12*b* by fluid discharging from the second cylinder's inlet/outlet port 33*b*. Hydraulic or pneumatic fluid is prevented from leaking beyond the pressure seals 22, which form a positive seal between each cylinder and its corresponding rod, and O-rings provided at the head end.

Figure 4:
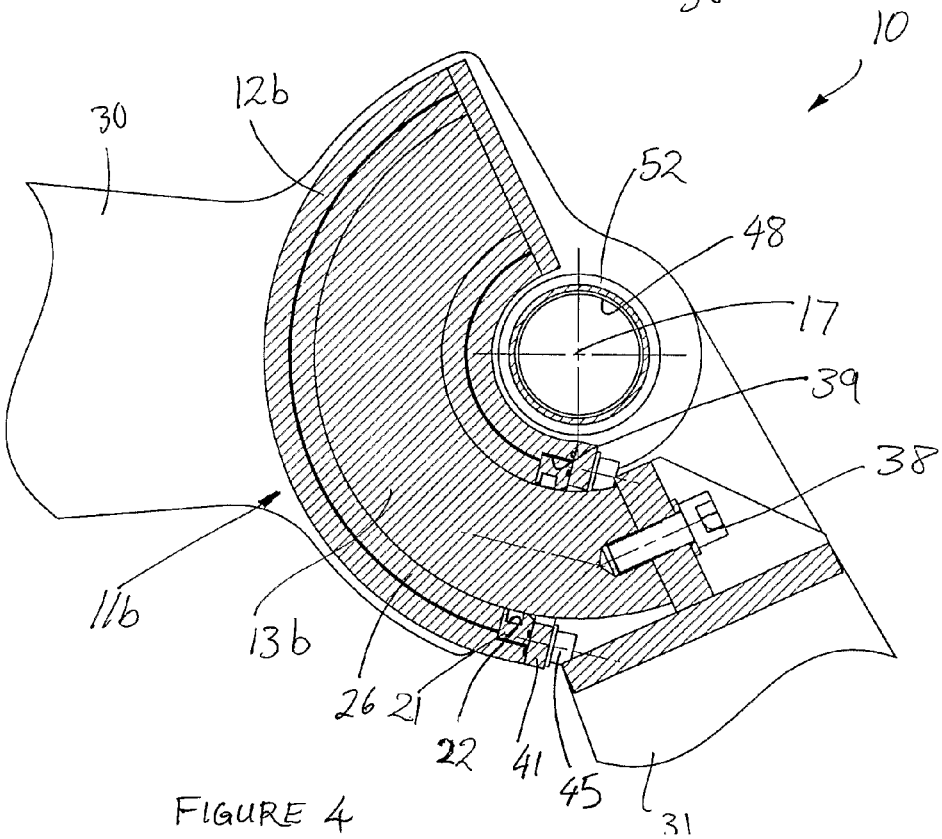
FIG. 4 is a side sectional view taken at section B-B of FIG. 2*b;*
Figure 5:
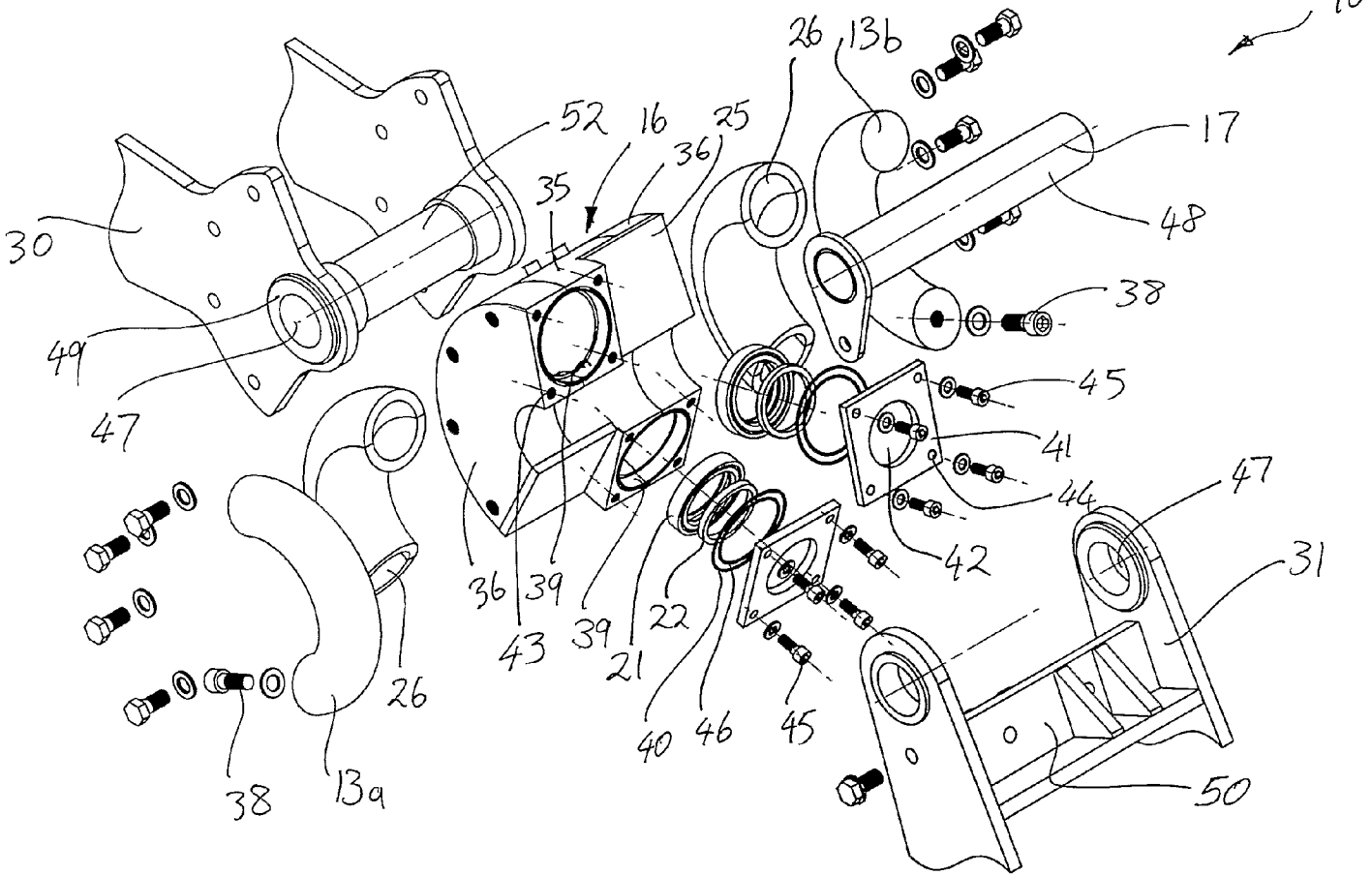
FIG. 5 is an exploded isometric view of the toroidal ram actuator.

Pressurizing first cylinder 12*a* forces first rod 13*a* to fully extend from cylinder 12*a*. This step is illustrated in FIGS. 1*a*, 2*a*, 2*b*, 2*c*, 3 and 4. Force is then transferred to the dynamic link 31 to which the leading end 28 of rod 13*a* is attached. This in turn produces a torque about the toroidal axis 17 and causes the dynamic link 31 to rotate about the toroidal axis in a first direction. Simultaneously, and in direct proportion, as rod 13*a* extends from cylinder 12*a*, second rod 13*b* retracts into cylinder 12*b* under the force imparted by the first rod and transferred through dynamic link 31, to which the second rod is also attached on an opposing side thereof to the first rod. FIG. 4, which shows section B-B of FIG. 2*b*, illustrates second rod 13*b* fully retracted inside cylinder 12*b*.

Hydraulic pressure is then relieved from the first cylinder 12*a* and pressure is applied to the second cylinder 12*b*, which actuates second rod 13*b* to extend. Force is transferred to the attached dynamic link in the opposite direction to that of first rod 13*a*, and an opposite torque is created about the toroidal axis 17, resulting in rotation of the dynamic link 31 in the opposite direction. FIG. 1*b* illustrates dynamic link 31 partially rotated where rods 13*a* and 13*b* are partially extended at an intermediate position. FIG. 1*c* illustrates link 31 rotated, with first rod 13*a* fully retracted and second rod 13*b* fully extended.

This process is repeated to alternate actuation of the first and second rams 11*a*, 11*b*, to thereby reciprocally move dynamic link 31 along an arcuate path centred at toroidal axis 17.

A removable cover may be provided over the toroidal ram actuator 10 to cover the moving rods 13 and prohibit these from being damaged.

The cylinder housing 11*b* in this embodiment is constructed from a number of separately machined and fabricated components which define the two opposing cylinders 12*a*, 12*b*. The housing parts comprise a central part 35, two outer parts 36, one to either side of central part 35, and two cylinder end caps 25 which close off the tail end 19 of the cylinders 12. The end cap 25 consists of a flat metal plate welded to the tail end of each cylinder.

The central part 35 is approximately half a revolution of a solid metal ring of rectangular section, that is machined on each side to form a semi toroidal shaped channel that is semi circular in cross section. The central part forms half of the internal surface of each cylinder.

The outer parts are formed from machining mating components to complete the cylinder formation on either side of the central part. The outer parts 36 are aligned and welded concentrically to each side of the said central part 35 to form a complete pair of axially offset and inverted cylinders. Aligning grooves may be machined into the mating surfaces to assist in alignment.

Another alternative method of constructing each said toroidal cylinder housing is to machine the internal toroidal surface from a solid metal disc using a special boring tool and boring machine. The boring tool and machine would be set up so that the tool rotates about the said common toroidal axis and cuts the internal toroidal surface in which the said composite channel and said toroidal rod is housed.

Machined into the head end 18 of each cylinder 12 is a cylindrical recess 39 of diameter greater than that of the internal cross-sectional diameter of the cylinder and facing inwardly of the cylinder. This recess 39 forms the recess in which the seal gland 21 is housed, which in turn supports the pressure seal 22. The external end face of the head end 18 is also machined to form a groove to receive a face seal such as an O-ring 40 or similar. The O-ring 40 seals a gland cover 41 against the cylinder 12. A second O-ring 46 sits in a groove in the seal gland to seal the gland against the end cover. Drilled and tapped holes 43 machined into the end face of the cylinder's head end 18 allow for fixing of the gland cover 41 to the head end 18 by way of fasteners 45.

The seal gland 21 is a cylindrical ring made of metal and/or composite material that sits, or 'floats', in the cylindrical recess 39 between the rod and the cylinder. A clearance between seal gland 21 and cylinder 12 serves a similar function to the clearance between the wear sleeve 26 and cylinder 12 in that the clearance allows for misalignment during movement of the rod. The depth of the cylindrical ring is equal to that of the said cylindrical recess 39 such that the seal gland sits flush with the external end face of the head end 18. The seal gland 21 extends into the chamber so that the pressure seal 22 contacts the rod.

The seal gland may optionally be made of a composite material similar to that of the composite sleeve 26 with material properties that give the gland better wear characteristics. Such composite materials have low porosity which provides good sealing properties.

The seal gland cover 41 illustrated in the figures is a machined flat metal plate with a cylindrical opening 42 in the centre through which rod 13 extends. Around the periphery of the plate are holes 44 which align with the drilled and tapped holes 43 on the face of the head end 18 of each cylinder. Fasteners such as cap screws are used to attach the seal gland cover 41 to the head end 18 of each cylinder 12. The gland cover seals against the O-rings 40 and 46 preventing hydraulic or pneumatic fluid escaping from the cylinder chamber 20. A wiper seal (not shown) could be attached or housed on the outside of the seal gland cover and concentric with the opening 42 and would bear against the rod 13 to prevent dirt/debris from entering the seal gland 21.

The pressure seals 22 and wiper seals may be standard linear ram seals, have a geometry that adapts to the arcuate surface of the toroidal shaped rods, or may be custom made seals having an arcuate sealing surface to match the arcuate surface of the rods. One example of a suitable pressure seal is U-seal having a depth that will not compromise seal performance and durability in sealing against a toroidal shaped rod. The pressure and wiper seals may be made from a polyurethane/rubber based material or a similar material/s to that used in standard hydraulic or pneumatic rod seals.

A number of drilled and tapped holes in the side of housing 16 are used to attach the cylinder housing to the fixed link 30 using fasteners 45 such as bolts or cap screws.

In the first embodiment of the actuator illustrated in FIGS. 1-5 the fixed link 30 includes through holes 47 that align with the toroidal axis 17 to support a pivoting pin 48 used to attach the fixed link 30 to dynamic link 31. Pivoting pin 48 extends through similar holes 47 in dynamic link 31. Bearings 49 and/or bushes 52 mounted in the through holes 47 allow dynamic link 31 to rotate relative to fixed link 30.

Figure 1B:
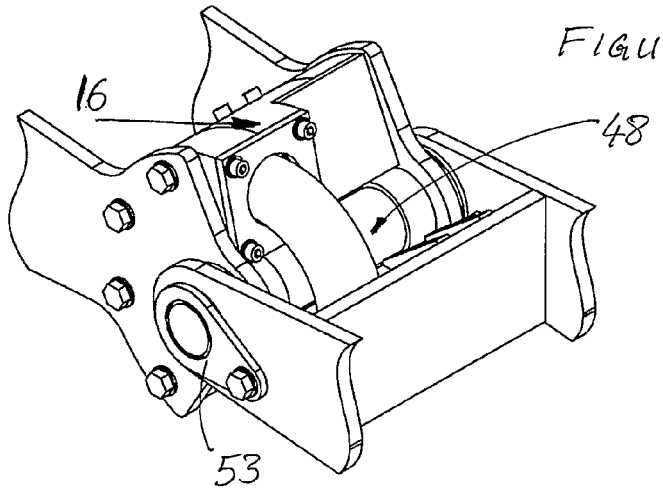
FIG. 1*b* is the same view as FIG. 1*a* but illustrating the first ram and a second ram at intermediate positions.
Figure 1C:
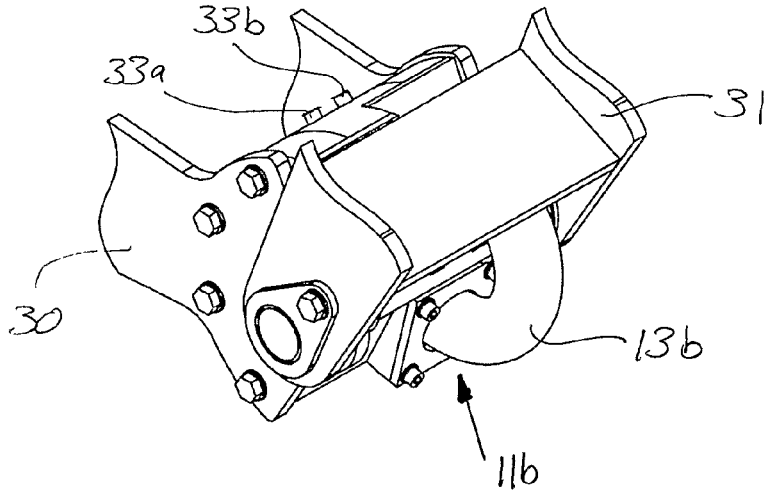
FIG. 1*c* is the same view as FIG. 1*a* but illustrating the second ram in a fully extended position.
Figure 2A:
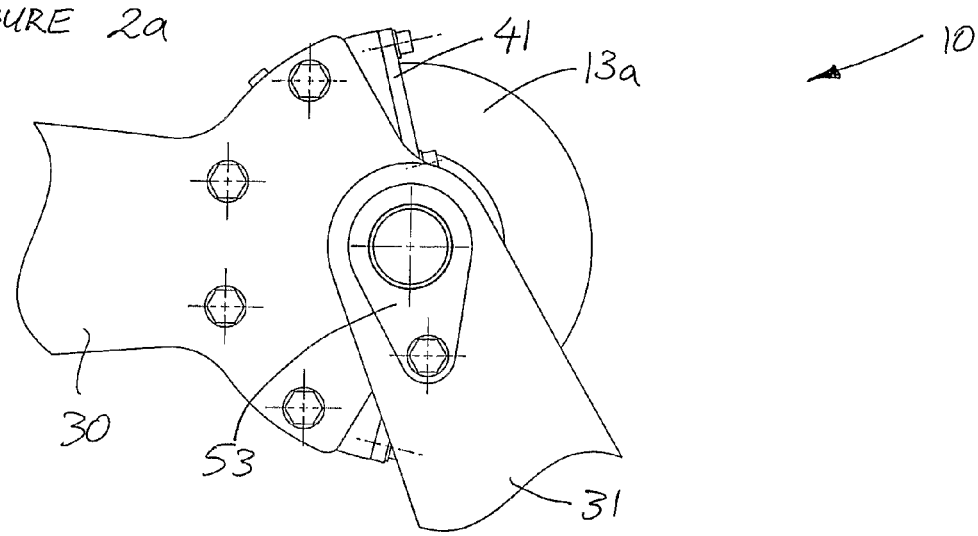
FIG. 2*a* is a side elevation of the toroidal ram actuator.
Figure 2B:
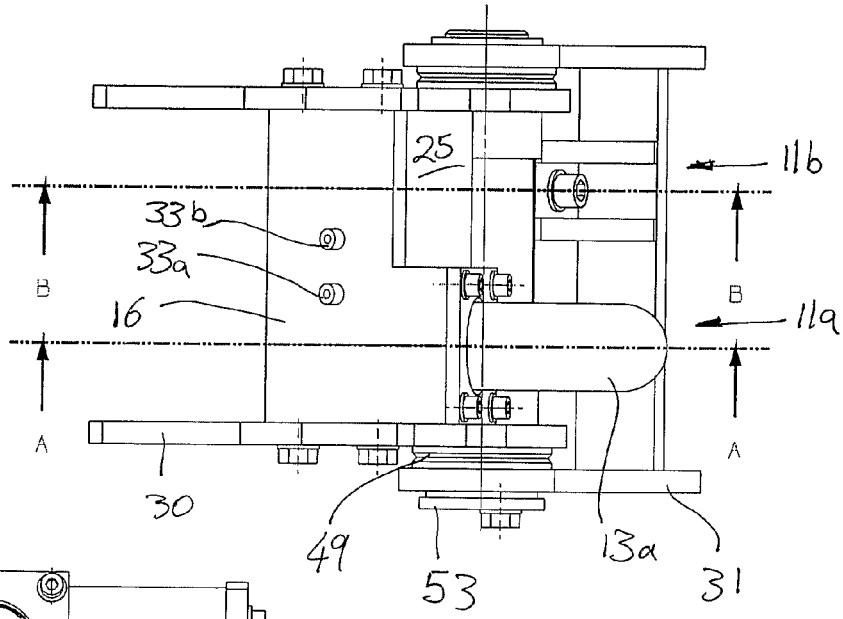
FIG. 2*b* is a plan view of the toroidal ram actuator illustrated in FIG. 2*a;*
Figure 2C:
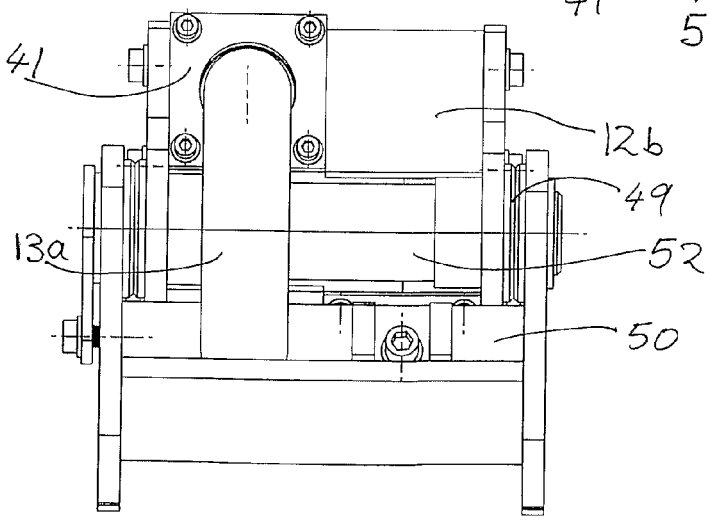
FIG. 2*c* is a front elevation of the toroidal ram actuator illustrated in FIG. 2*a;*
Figure 3:
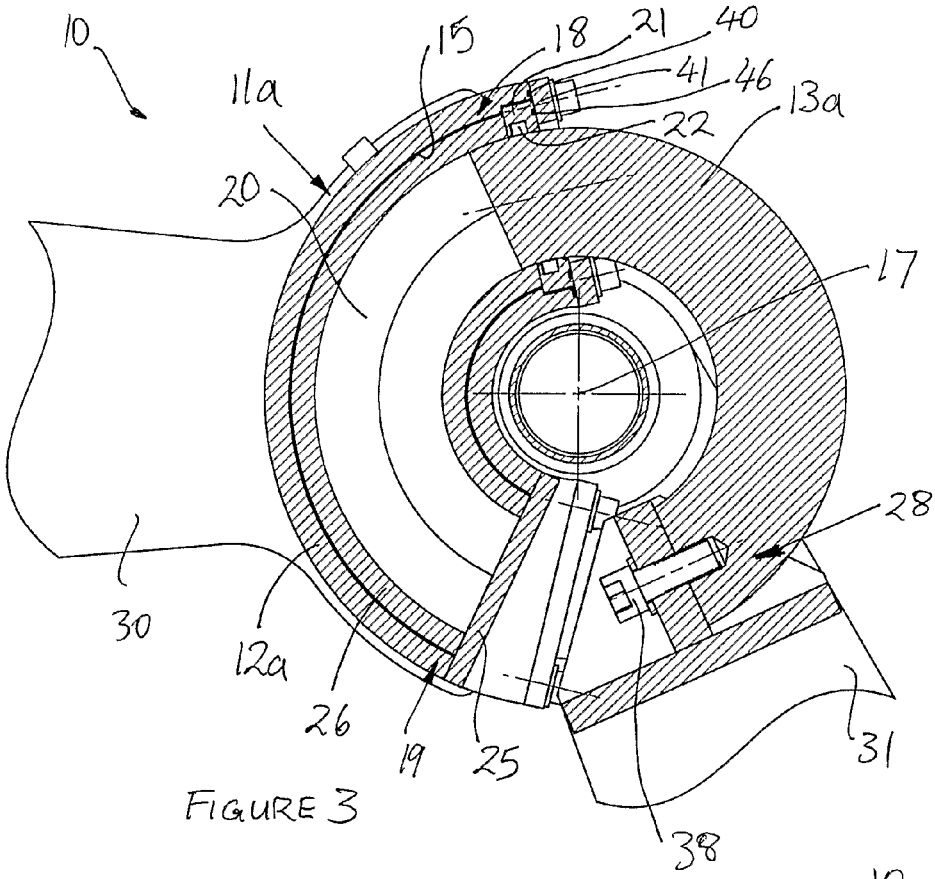
FIG. 3 is a side sectional view taken at section A-A of FIG. 2*b;*

A pivoting pin plate 53 attached to the end of pin 48 and fixed, in FIGS. 1*a*-1*c*, to the dynamic link 31, rigidly fixes the pin to the dynamic link or the fixed link, as desired, to prevent undesired rotation of the pin 48.

Figure 6:
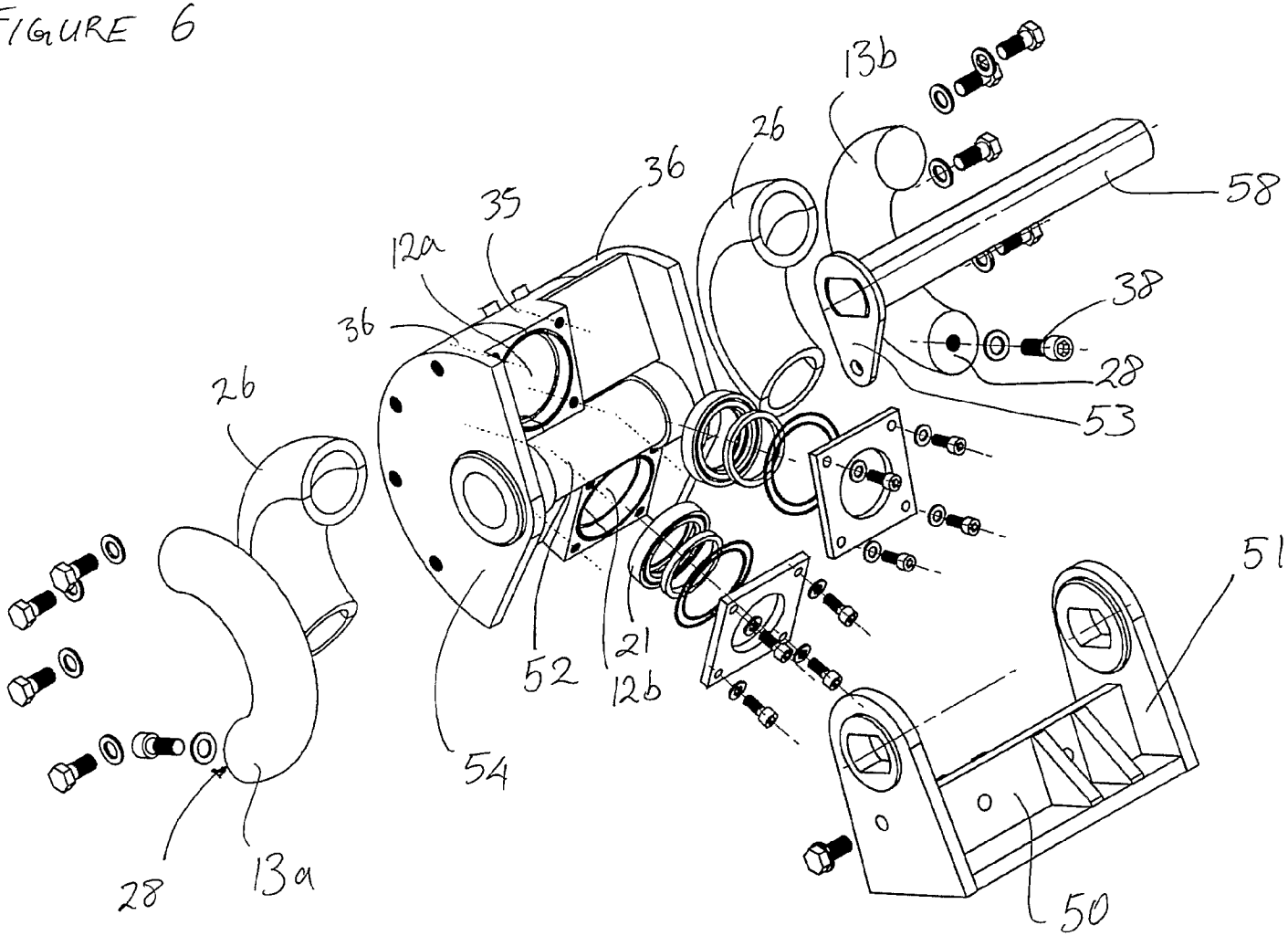
FIG. 6 is an exploded isometric view of a second embodiment of the toroidal ram actuator.

The above described embodiment which is illustrated in FIGS. 1-5 is used to drive a member, such as the dynamic link 31. FIG. 6 illustrates a second embodiment which is a variation on the actuator of the first embodiment in that it is used to produce rotary output motion of the pivoting pin 48 to harness the reciprocating shaft rotary motion of the pin 48. The pivoting pin 48 in this embodiment takes the role of an output shaft 58 and the dynamic link 31 takes on the role of a torque arm 51. This variation may only be suitable for lower torque output applications such as pneumatic applications due to limitations in the torque transmitting capabilities of the output shaft.

FIG. 6 shows that cylinder housing 16 comprises an integrated solid plate 54 on each side thereof. The fixed link in the second embodiment is not illustrated in FIG. 6. A through hole 47 concentric with the toroidal axis 17 supports output shaft 58, bearing 49 and bushes 52.

The torque arm 51 is similar in design to the dynamic link 31, but has no protruding length beyond the point of attachment of the rods 17 because there is no need for the torque arm to drive a member but instead functions to transmit the torque to the said output shaft.

The design of the bushes 49 located in holes 47 is such that the output shaft which passes through the bushes 49 is mechanically linked to the torque arm 51 such that when the torque arm is rotated, the output shaft also rotates. The mechanical link may be in the form of a mechanical attachment such as bushes with two internal flats on the side and corresponding flats machined on the output shaft as illustrated in FIG. 6, or may involve more complex geometry such as an internal spline on the bushes and a corresponding external spline on the said output shaft. Any other form of matching geometry to mechanically link the said torque arm to the said output shaft may be used.

As discussed above, the toroidal ram actuator may use double acting toroidal ram/s in replacement of the two opposing single acting toroidal rams. The single acting toroidal ram only forces the rod outwardly of the cylinder and relies on an external force to push the rod to retract. One double acting ram actuator could be used to actuate both the extension of the rod and its retraction. Hence, only a single, double acting toroidal ram would be required to produce rotation of the output shaft or dynamic link in both directions, replacing two single acting rams.

Accordingly, the actuator 10 may consist of two single acting toroidal rams, or a combination of any number of single or double acting rams axially aligned, offset and/or inverted. Single acting toroidal rams are preferably grouped in opposing pairs.

The proposed actuator 10 defines each said toroidal cylinder and corresponding said toroidal rod as being circular in cross section. However the toroidal surface of both the cylinder 12 and the rod 13 may be of a cross section that resembles something other than a circle. For example, an elliptical toroidal surface may be used as well as custom elliptical pressure and wiper seals.

The above metal components of the toroidal ram actuator 10 have been described as being formed by machining. It is understood, however, that the components may be casted in accurate cast mouldings and then machined as required.

Alternatively, it may be suitable in some lighter applications, such as in a pneumatic actuator which may only requires small output torques and hence small loads, to replace the metal components with a suitable plastic material. The plastic parts may be moulded or machined from raw materials. The overall relative geometry of the toroidal ram actuator in plastic would be similar to that of the above described machined and welded embodiments.

The size of the toroidal ram actuator varies according to the application in which it is used. For example, a large actuator would be required in applications such as actuating the arms of excavators, cranes and other heavy earth moving equipment, mining equipment or agricultural equipment. Smaller versions of the actuator may be used in manufacturing processes where pneumatic production equipment is used or the like. Essentially, the present toroidal ram actuator can replace linear ram actuators currently used in any application where rotary motion is to be produced.

It will be understood to persons skilled in the art of the invention that many modifications may be made without departing from the spirit and scope of the invention.

The claims defining the invention are as follows:

1. A toroidal ram actuator comprising two part toroidal shaped cylinders mounted to a first member and a part toroidal piston reciprocally movable within each cylinder, a free end of each piston being mounted to a second member, the first and second members being relatively pivotable about a toroidal axis with the relative movement between the cylinder and piston producing rotary motion of the first or second member about the axis, wherein the cylinders are axially offset relative to the toroidal axis and are inverted such that the pistons meet on opposite sides of the second member.

2. The toroidal ram actuator claimed in claim 1 wherein the piston and cylinder are substantially semi-toroidal in shape.

3. The toroidal ram actuator claimed in claim 1 wherein the cylinder has a closed end and operates piston movement hydraulically or pneumatically.

4. The toroidal ram actuator claimed in claim 1 wherein the first and second members are pivotally attached by way of a pivot pin aligned on the toroidal axis.

5. The toroidal ram actuator claimed in claim 4 wherein the pivot pin is fixed to the second member such that the rotary motion is imparted on the pivot pin which defines an output shaft.

6. The toroidal ram actuator claimed in claim 1 wherein the cylinders are adjacent each other.

7. The toroidal ram actuator claimed in claim 6 wherein the cylinders are provided in a single housing.

8. The toroidal ram actuator claimed in claim 1 wherein each cylinder has a fluid inlet/outlet port and is a single acting cylinder to actuate movement of the respective piston outwardly of the cylinder.

9. The toroidal ram actuator claimed in claim 1 wherein the first member is a static link relative to the second member.

10. The toroidal ram actuator claimed in claim 1 wherein the second member is a dynamic link that subscribes a part-arcuate path relative to the first member.

11. The toroidal ram actuator claimed in claim 4 wherein the second member is a dynamic link relative to the first member, whereby both pistons are attached to opposite sides of a reaction surface on the dynamic link.

12. The toroidal ram actuator claimed in claim 1 wherein a sleeve is provided inside the cylinder.

13. The toroidal ram actuator claimed in claim 12 wherein the sleeve is a wear sleeve that supports and guides the piston.

14. The toroidal ram actuator claimed in claim 13 wherein a clearance is provided between the wear sleeve and cylinder to compensate for misalignment in piston movement.

15. The toroidal ram actuator claimed in claim 13 wherein the sleeve is made of a composite material.

16. The toroidal ram actuator claimed in claim 15 wherein the composite material is nickel filled polytetrafluoroethylene material.

17. The toroidal ram actuator claimed in claim 3 wherein a circular seal gland is provided at an open end of the cylinder to support a seal for preventing leakage of hydraulic or pneumatic fluid from the cylinder.

18. The toroidal ram actuator claimed in claim 17 wherein the seal gland floats in a recess provided at the open end of the cylinder whereby a clearance is provided between the seal gland and cylinder so to compensate for any misalignment in piston movement.

19. The toroidal ram actuator claimed in claim 17 wherein the seal gland has recessed grooves for supporting a pressure seal and an O-ring.

20. The toroidal ram actuator claimed in claim 1 wherein the cylinder has two inlet/outlet ports and is a double acting cylinder to actuate movement of the piston outwardly and inwardly of the cylinder.

21. The toroidal ram actuator claimed in claim 1 wherein the housing and piston are formed by machining and/or casting.

* * * * *